US007902953B1

(12) United States Patent
Watt

(10) Patent No.: US 7,902,953 B1
(45) Date of Patent: Mar. 8, 2011

(54) METHOD AND APPARATUS FOR IMPROVING INDUCTOR PERFORMANCE USING MULTIPLE STRANDS WITH TRANSPOSITION

(75) Inventor: Jeffrey T. Watt, Palo Alto, CA (US)

(73) Assignee: Altera Corporation, San Jose, CA (US)

( * ) Notice: Subject to any disclaimer, the term of this patent is extended or adjusted under 35 U.S.C. 154(b) by 71 days.

(21) Appl. No.: 12/228,956

(22) Filed: Aug. 18, 2008

(51) Int. Cl.
*H01F 5/00* (2006.01)

(52) U.S. Cl. ..... 336/200; 336/223; 336/232

(58) Field of Classification Search ..... None
See application file for complete search history.

(56) References Cited

U.S. PATENT DOCUMENTS 6,798,039 B1 9/2004 Gillespie
7,109,585 B2 * 9/2006 Kang et al. ..... 257/758
7,109,838 B2 * 9/2006 Brennan et al. ..... 336/200
2001/0052838 A1 * 12/2001 Hamanaka et al. ..... 336/200
2004/0108933 A1 * 6/2004 Chen et al. ..... 336/200
2006/0284718 A1 * 12/2006 Baumgartner et al. ..... 336/223
2009/0027150 A1 * 1/2009 Gianesello ..... 336/200
2009/0315662 A1 * 12/2009 Hijioka et al. ..... 336/200

* cited by examiner

*Primary Examiner* — Anh T Mai
(74) *Attorney, Agent, or Firm* — L. Cho

(57) ABSTRACT

A spiral inductor includes a winding that includes a plurality of strands. The spiral inductor also includes a plurality of tracks where a first set of tracks is positioned adjacent to one another on a first of layer and a second set of tracks is positioned adjacent to one another on a second layer. Each of the plurality of tracks is capable of supporting one of the plurality of strands. The spiral inductor also includes a plurality of crossing segments to transpose one or more of the plurality of strands to each of the plurality of tracks, wherein each of the plurality of strands is electrically isolated from the other plurality of strands.

29 Claims, 9 Drawing Sheets

METHOD AND APPARATUS FOR IMPROVING INDUCTOR PERFORMANCE USING MULTIPLE STRANDS WITH TRANSPOSITION

TECHNICAL FIELD

Embodiments of the present invention relate to inductor-based circuits. More specifically, embodiments of the present invention relate to a method and apparatus for improving inductor performance using multiple strands with transposition.

BACKGROUND

Spiral inductors are important components of many high-frequency circuits such as voltage controlled oscillators, low noise amplifiers, mixers, and other components. Generally, a high quality factor, Q, is desirable for high performance. A high quality factor translates to lower phase noise in voltage controlled oscillators and a lower noise figure in low noise amplifiers.

The quality factor is a function of energy stored, which may be defined by the difference between peak magnetic energy and peak electric energy, and the energy loss in one oscillation cycle. The quality factor is limited by energy stored in parasitic capacitance, ohmic loss in the inductor windings, and energy loss in the substrate. Resistance in the inductor windings increases with frequency due to skin effect and proximity effect which causes significant degradation in the inductor's quality factor.

The skin effect causes AC current to crowd towards a surface of an inductor winding due to self induction. The proximity effect causes AC current to crowd towards the outer edges of parallel lines due to mutual induction. The skin effect and proximity effect are caused by eddy currents which are induced by time-varying magnetic field. Eddy currents flow in a direction that produces an opposing magnetic field. Eddy currents combine with applied currents and result in current crowding on edges of lines.

Prior approaches of increasing the width of an inductor winding had limited benefits since most AC current flows along the sides of the winding due to the lateral skin effect and proximity effect. Also, the utilization of multiple metal levels for winding had limited benefit because most AC current flows through the top surface of the top metal and the bottom surface of the bottom metal in an inductor metal stack.

SUMMARY

According to an embodiment of the present invention, an inductor winding is split into multiple strands. The strands may be split laterally and/or vertically. According to one aspect of the present invention, the strands are transposed along the length of the winding. According to another aspect of the present invention, the strands are transposed such that all possible positions in the winding cross section are occupied equally or approximately the same distance along the length of the winding.

BRIEF DESCRIPTION OF THE DRAWINGS

The features and advantages of the present invention are illustrated by way of example and are by no means intended to limit the scope of the present invention to the particular embodiments shown.

DETAILED DESCRIPTION

In the following description, for purposes of explanation, specific nomenclature is set forth to provide a thorough understanding of embodiments of the present invention. It will be apparent to one skilled in the art that specific details in the description may not be required to practice the embodiments of the present invention. In other instances, well-known circuits, devices, and programs are shown in block diagram form to avoid obscuring embodiments of the present invention unnecessarily. Additionally, some embodiments of the invention are described in the context of field programmable gate arrays ("FPGA"), but the invention is applicable to other contexts as well, including other semiconductor devices such as programmable logic devices, complex programmable logic devices, application specific integrated circuits, processors, controllers and memory devices.

Figure 1:
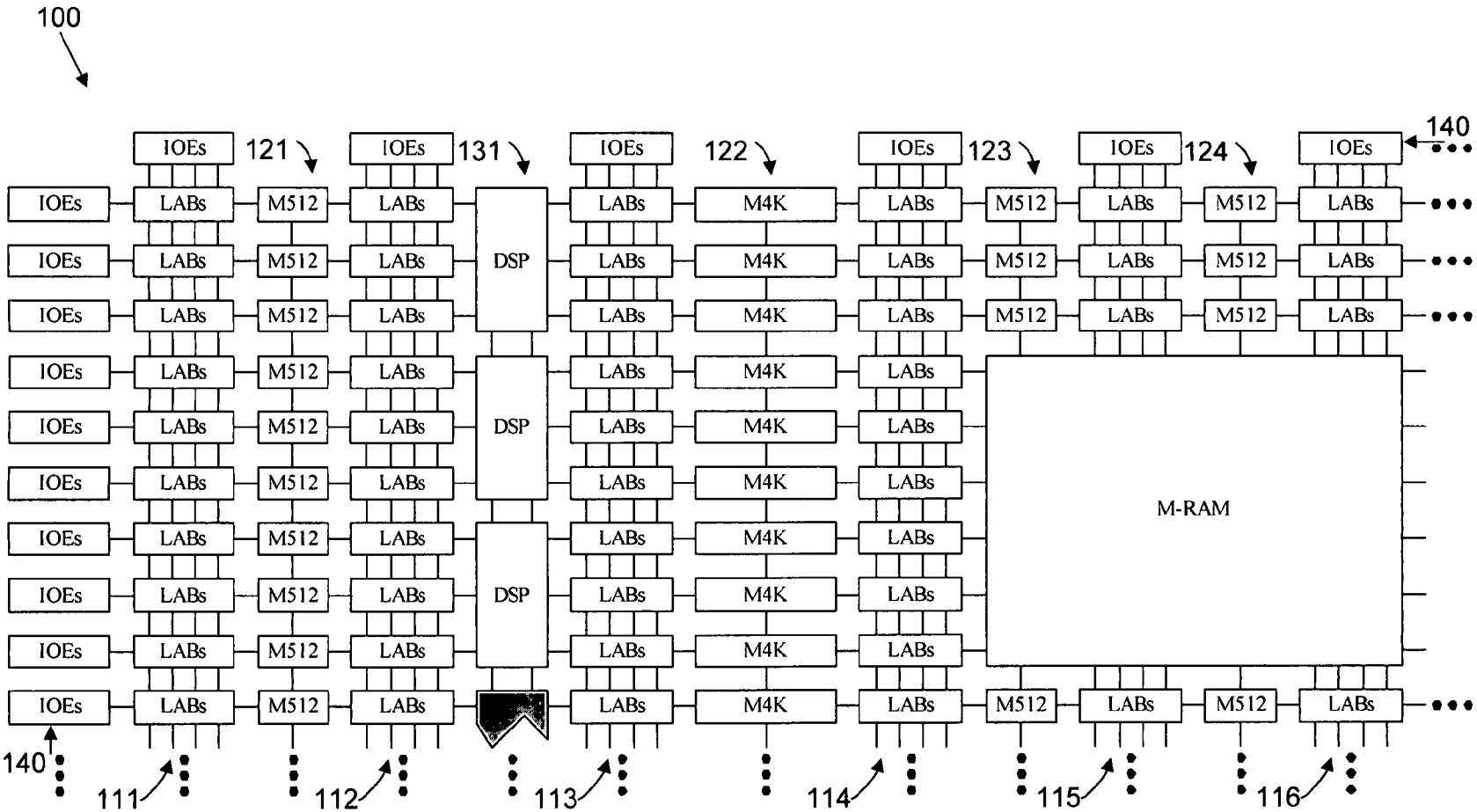
FIG. 1 illustrates a target device in which a spiral inductor may be implemented according to an exemplary embodiment of the present invention.

FIG. 1 illustrates a device 100 which implements spiral inductors according to an exemplary embodiment of the present invention. In this example, the device 100 is a target device such as an FPGA which a system may be implemented on. The target device 100 may be a semiconductor device having a hierarchical structure that may take advantage of wiring locality properties of circuits formed therein.

The target device 100 includes a plurality of logic-array blocks (LABs). Each LAB may be formed from a plurality of logic blocks, carry chains, LAB control signals, (lookup table) LUT chain, and register chain connection lines. A logic block is a small unit of logic providing efficient implementation of user logic functions. A logic block includes one or more combinational cells, where each combinational cell has a single output, and registers. According to one embodiment of the present invention, the logic block may operate similarly to a logic element (LE), such as those found in Stratix® devices manufactured by Altera Corporation, or a combinational logic block (CLB) such as those found in Virtex devices manufactured by Xilinx Inc. In this embodiment, the logic block may include a four input lookup table (LUT) with a configurable register. According to an alternate embodiment of the present invention, the logic block may operate similarly to an adaptive logic module (ALM), such as those found in Stratix devices manufactured by Altera Corporation. LABs are grouped into rows and columns across the target device 100. Columns of LABs are shown as 111-116. It should be appreciated that the logic block may include additional or alternate components.

The target device 100 includes memory blocks. The memory blocks may be, for example, dual port random access memory (RAM) blocks that provide dedicated true dual-port, simple dual-port, or single port memory up to various bits wide at up to various frequencies. The memory blocks may be grouped into columns across the target device in between selected LABs or located individually or in pairs within the target device 100. Columns of memory blocks are shown as 121-124.

The target device 100 includes digital signal processing (DSP) blocks. The DSP blocks may be used to implement multipliers of various configurations with add or subtract features. The DSP blocks include shift registers, multipliers, adders, and accumulators. The DSP blocks may be grouped into columns across the target device 100 and are shown as 131.

The target device 100 includes a plurality of input/output elements (IOEs) 140. Each IOE feeds an I/O pin (not shown) on the target device 100. The IOEs are located at the end of LAB rows and columns around the periphery of the target device 100. According to an embodiment of the present invention, the IOEs 140 are high speed serial IOEs. Each IOE includes a bidirectional I/O buffer and a plurality of registers for registering input, output, and output-enable signals. When used with dedicated clocks, the registers provide performance and interface support with external memory devices. According to an embodiment of the present invention, each of the IOEs 140 may also include a voltage controlled oscillator having a spiral inductor. The spiral inductor may be a multi-stranded spiral inductor utilizing vertical and/or lateral transposition.

The target device 100 may include routing resources such as LAB local interconnect lines, row interconnect lines ("H-type wires"), and column interconnect lines ("V-type wires") (not shown) to route signals between components on the target device.

FIG. 1 illustrates an exemplary embodiment of a target device. It should be appreciated that a system may include a plurality of target devices, such as that illustrated in FIG. 1, cascaded together. It should also be appreciated that, as indicated above, the target device may include the same or different semiconductor devices arranged in a different manner. A target device may also include FPGA resources other than those described in reference to the target device 100. Thus, while the invention described herein may be utilized on the architecture described in FIG. 1, it should be appreciated that it may also be utilized on different architectures and on different semiconductor devices.

Figure 2B:
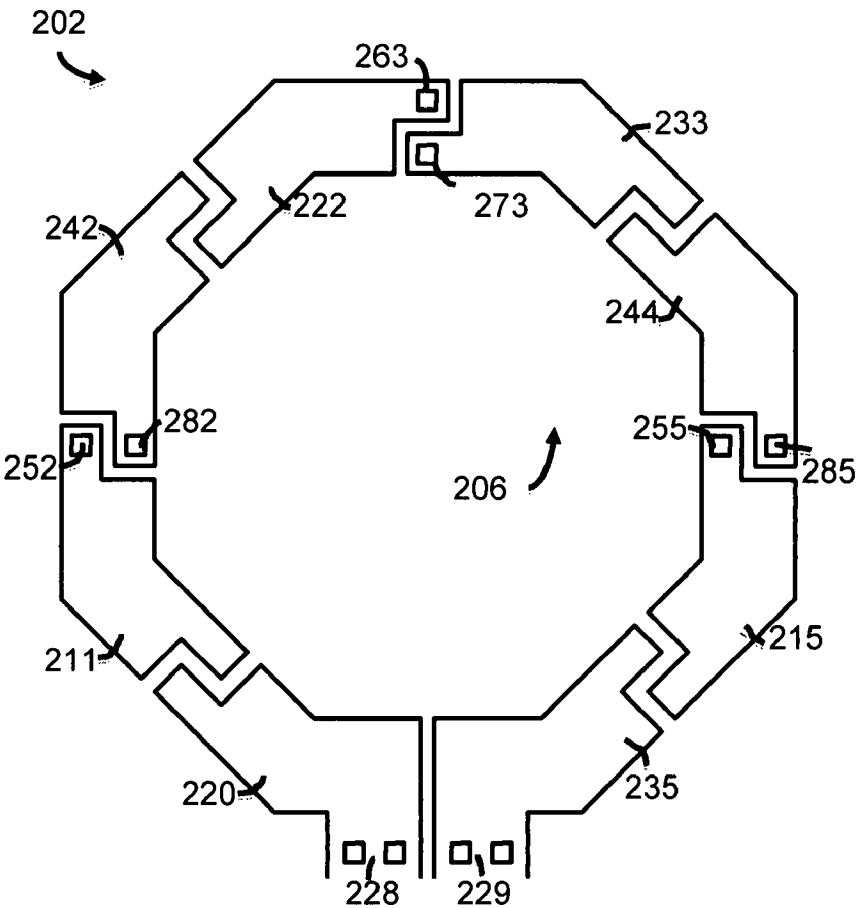
FIG. 2*a-d* illustrates a spiral inductor with vertical transposition according to an exemplary embodiment of the present invention.
Figure 2A:
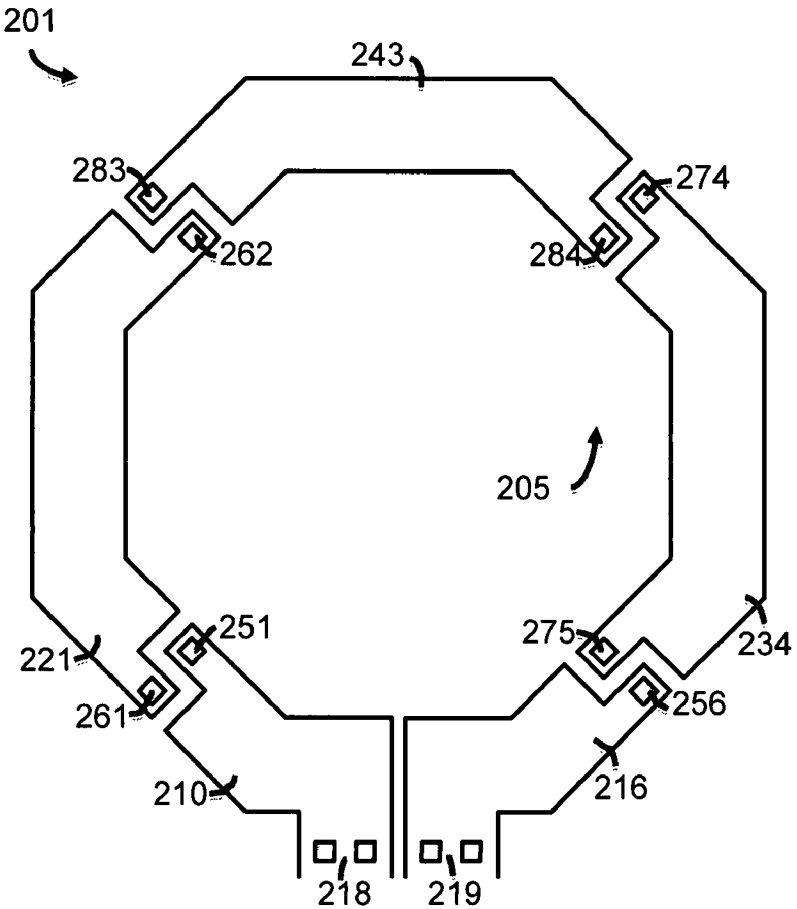
Figure 2D:
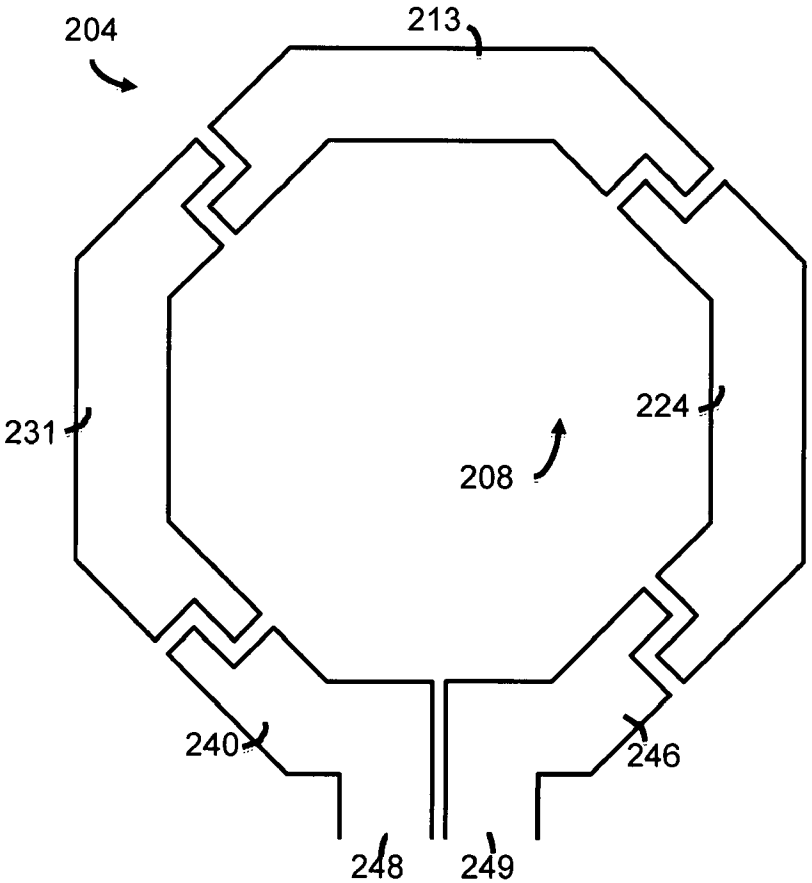
Figure 2C:
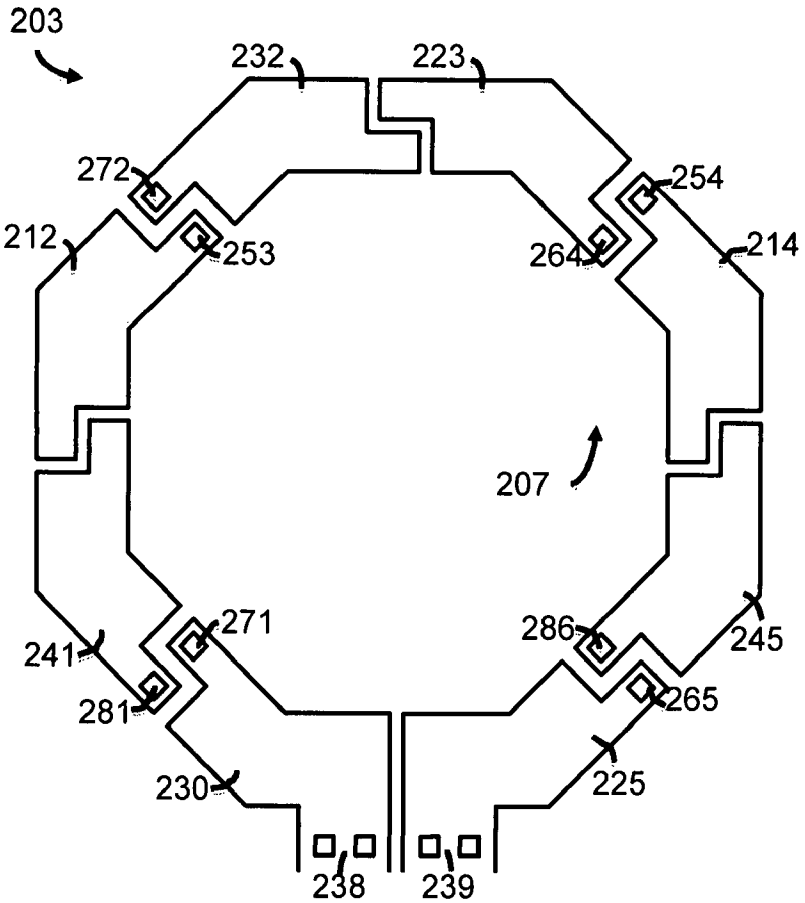

FIGS. 2*a-d* illustrate a layout view of a four layer spiral inductor with vertical transposition according to an exemplary embodiment of the present invention. Layer 201 shown in FIG. 2*a* represents a first metal layer (metal n). Layer 202 shown in FIG. 2*b* represents a second metal layer (metal n+1). Layer 203 shown in FIG. 2*c* represents a third metal layer (metal n+2). Layer 204 shown in FIG. 2*d* represents a fourth metal layer (metal n+3). The metal layers 201-204 each include a track 205-208. Each track spans the distance of a winding of the spiral inductor and supports segments of strands of the winding. As shown, track 205 supports strand segments 210, 221, 243, 234, and 216. Track 206 supports strand segments 220, 211, 242, 222, 233, 244, 215, and 235. Track 207 supports strand segments 230, 241, 212, 232, 223, 214, 245, and 225. Track 208 supports strand segments 240, 231, 213, 224, and 246.

FIG. 2*a* illustrates a first strand coupled to terminal 218 and 219 on track 205. The first strand includes strand segment 210 which resides on track 205, strand segment 211 which resides on track 206, strand segment 212 which resides on track 207, strand segment 213 which resides on track 208, strand segment 214 which resides on track 207, strand segment 215 which resides on track 206, and strand segment 216 which resides on track 205. As illustrated, crossing segment 251 transposes the first strand from track 205 on layer 201 to track 206 on layer 202. Crossing segment 252 transposes the first strand from track 206 on layer 202 to track 207 on layer 203. Crossing segment 253 transposes the first strand from track 207 on layer 203 to track 208 on layer 204. Crossing segment 254 transposes the first strand from track 208 on layer 204 to track 207 on layer 203. Crossing segment 255 transposes the first strand from track 207 on layer 203 to track 206 on layer 202. Crossing segment 256 transposes the first strand from track 206 on layer 202 to track 205 on layer 201.

A second strand is coupled to terminals 228 and 229 which resides on track 206. The second strand includes strand segment 220 which resides on track 206, strand segment 221 which resides on track 205, strand segment 222 which resides on track 206, strand segment 223 which resides on track 207, strand segment 224 which resides on track 208, and strand segment 225 which resides on track 207. As illustrated, crossing segment 261 transposes the second strand from track 206 on layer 202 to track 205 on layer 201. Crossing segment 262 transposes the second strand from track 205 on layer 201 to track 206 on layer 202. Crossing segment 263 transposes the second strand from track 206 on layer 202 to track 207 on layer 203. Crossing segment 264 transposes the second strand from track 207 on layer 203 to track 208 on layer 204. Crossing segment 265 transposes the second strand from track 208 on layer 204 to track 207 on layer 203.

A third strand is coupled to terminals 238 and 239 on track 207. The third strand includes strand segment 230 which resides on track 207, strand segment 231 which resides on track 208, strand segment 232 which resides on track 207, strand segment 233 which resides on track 206, strand segment 234 which resides on track 205, and strand segment 235 which resides on track 206. As illustrated, crossing segment 271 transposes the third strand from track 207 on layer 203 to track 208 on layer 204. Crossing segment 272 transposes the third strand from track 208 on layer 204 to track 207 on layer 203. Crossing segment 273 transposes the third strand from track 207 on layer 203 to track 206 on layer 202. Crossing segment 274 transposes the third strand from track 206 on layer 202 to track 205 on layer 201. Crossing segment 275 transposes the third strand from track 205 on layer 201 to track 206 on layer 202.

A fourth strand is coupled to terminals 248 and 249 on track 208. The fourth strand includes strand segment 240 which resides on track 208, strand segment 241 which resides on track 207, strand segment 242 which resides on track 206, strand segment 243 which resides on track 205, strand segment 244 which resides on track 206, strand segment 245 which resides on track 207, and strand segment 246 which resides on track 208. As illustrated, crossing segment 281 transposes the fourth strand from track 208 on layer 204 to track 207 on layer 203. Crossing segment 282 transposes the fourth strand from track 207 on layer 203 to track 206 on layer 202. Crossing segment 283 transposes the fourth strand from track 206 on layer 202 to track 205 on layer 201. Crossing segment 284 transposes the fourth strand from track 205 on layer 201 to track 206 on layer 202. Crossing segment 285 transposes the fourth strand from track 206 on layer 202 to track 207 on layer 203. Crossing segment 286 transposes the fourth strand from track 207 on layer 203 to track 208 on layer 204.

Figure 3:
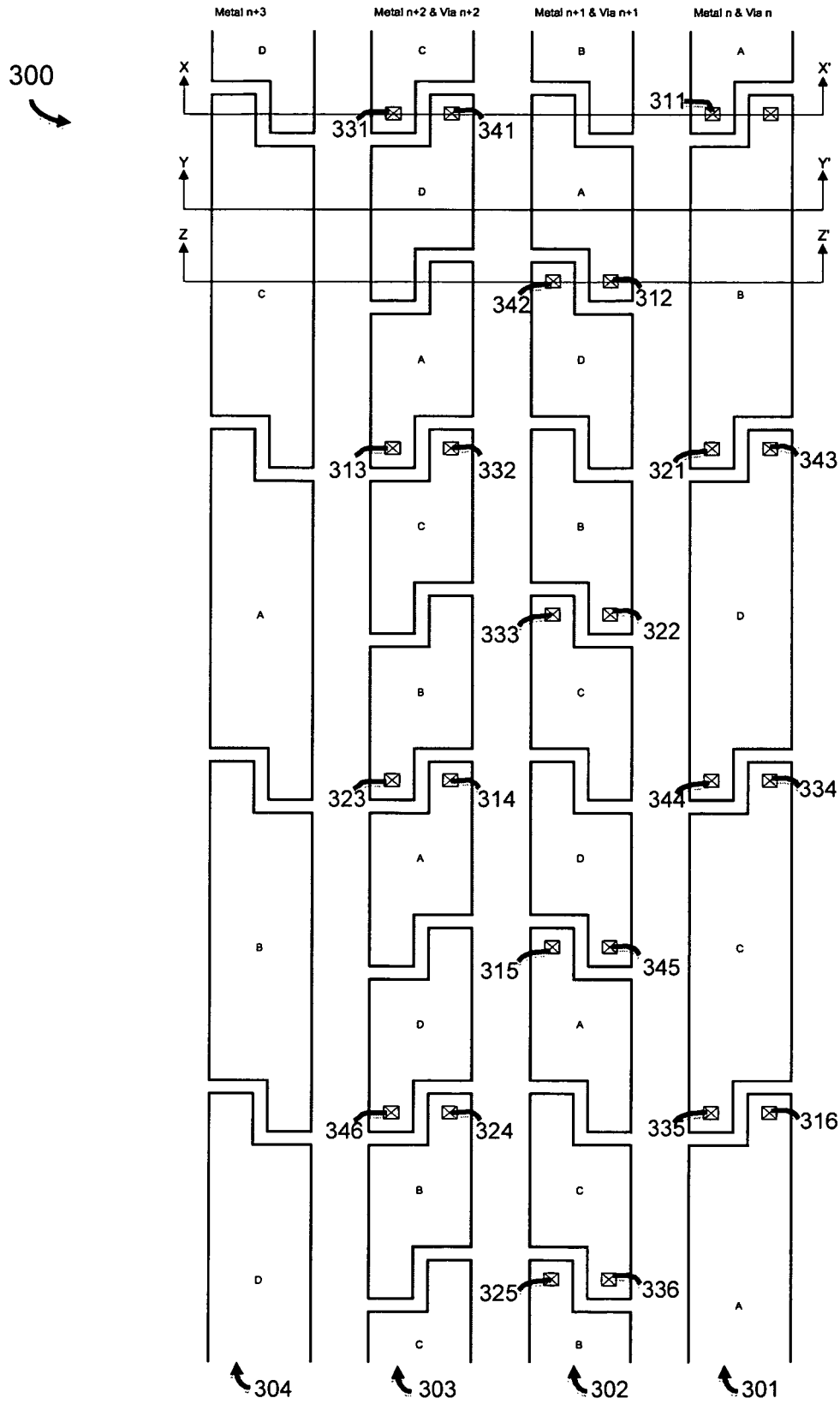
FIG. 3 illustrates a layout view of a multi-stranded magnetic component with vertical transposition according to an exemplary embodiment of the present invention.

FIG. 3 illustrates a layout view of a section of a multi-stranded magnetic component 300 with vertical transposition according to an exemplary embodiment of the present invention. The layout view illustrates four layers of the magnetic component 300, metal n, metal n+1, metal n+2, and metal n+3. A first track 301 resides on a first layer (metal n) of the magnetic component 300. A second track 302 resides on a second layer (metal n+1) of the magnetic component 300. A third track 303 resides on a third layer (metal n+2) of the magnetic component. A fourth track 304 resides on a fourth layer (metal n+3) of the magnetic component.

Strands A, B, C, and D compose the winding of the magnetic component 300 and are vertically transposed through each of the tracks on magnetic component. Crossing segment 311 transposes strand A from track 301 to track 302. Crossing segment 312 transposes strand A from track 302 to track 303. Crossing segment 313 transposes strand A from track 303 to track 304. Crossing segment 314 transposes strand A from track 304 to track 303. Crossing segment 315 transposes strand A from track 303 to track 302. Crossing segment 316 transposes strand A from track 302 to track 301.

Crossing segment 321 transposes strand B from track 301 to track 302. Crossing segment 322 transposes strand B from track 302 to track 303. Crossing segment 323 transposes strand B from track 303 to track 304. Crossing segment 324 transposes strand B from track 304 to track 303. Crossing segment 325 transposes strand B from track 303 to track 302.

Crossing segment 331 transposes strand C from track 303 to track 304. Crossing segment 332 transposes strand C from track 304 to track 303. Crossing segment 333 transposes strand C from track 303 to track 302. Crossing segment 334 transposes strand C from track 302 to track 301. Crossing segment 335 transposes strand C from track 301 to track 302. Crossing segment 336 transposes strand C from track 302 to track 303.

Crossing segment 341 transposes strand D from track 304 to track 303. Crossing segment 342 transposes strand C from track 303 to track 302. Crossing segment 343 transposes strand D from track 302 to track 301. Crossing segment 344 transposes strand D from track 301 to track 302. Crossing segment 345 transposes strand D from track 302 to track 303. Crossing segment 346 transposes strand D from track 303 to track 304. In this example, 4 strands are supported by tracks 301-304. These strands are unique and electrically isolated from one another. According to an embodiment of the present invention, the electrical isolation provides that there is no DC current path between any two strands except at the terminals.

Figures 4A, 4B, 4C:
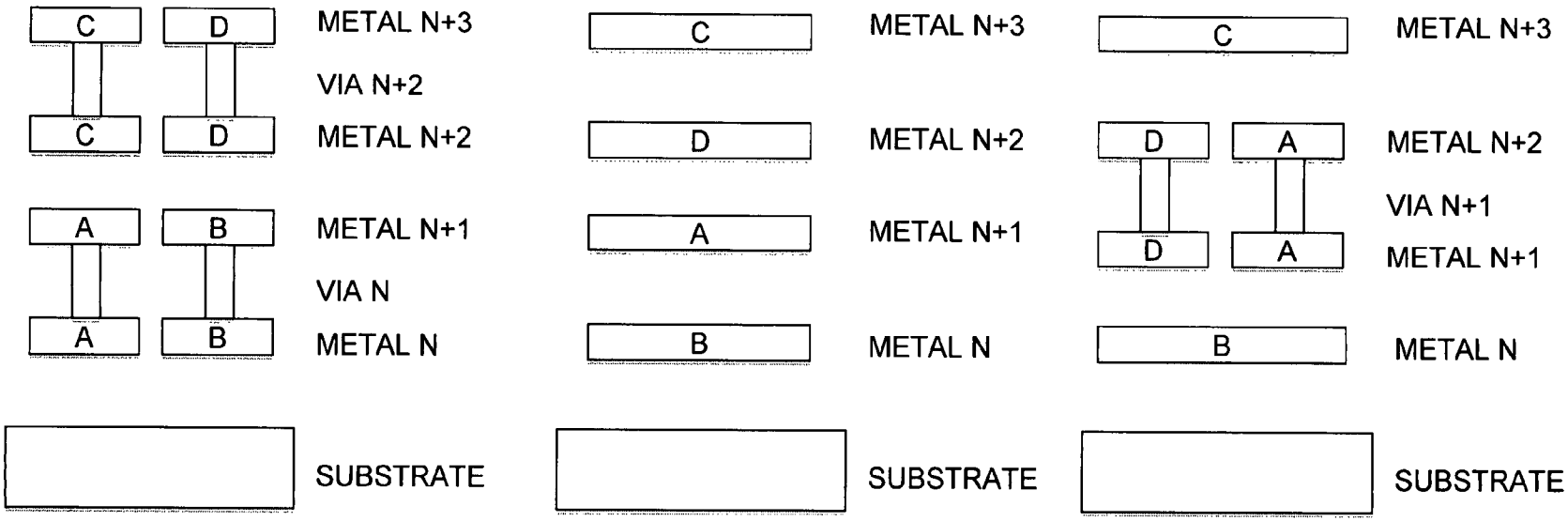
FIGS. 4*a*-4*c* illustrate cross-sectional views at positions of the multi-stranded magnetic component of FIG. 3 according to an embodiment of the present invention.

FIGS. 4*a*-4*c* illustrates cross-sectional views at positions of the multi-stranded magnetic component of FIG. 3 according to an embodiment of the present invention. FIG. 4*a* illustrates a cross-sectional view of the multi-stranded magnetic component 300 (shown in FIG. 3) at line X-X'. A strand segment for strand C and a strand segment for strand D are shown at the metal n+3 layer. A via is shown to connect the strand segment for strand C at the metal n+3 layer with the strand segment for strand C at the metal n+2 layer. A via is shown to connect the strand segment for strand D at the metal n+3 layer with the strand segment for strand D at the metal n+2 layer. A strand segment for strand A and a strand segment for strand B are shown at the metal n+1 layer. A via is shown to connect the strand segment for strand A at the metal n+1 layer with the strand segment for strand A at the metal n layer. A via is shown to connect the strand segment for strand B at the metal n+1 layer with the strand segment for strand B at the metal n layer.

FIG. 4*b* illustrates a cross-sectional view of the multi-stranded magnetic component 300 (shown in FIG. 3) at line Y-Y'. A strand segment for strand C is shown at the metal n+3 layer. A strand segment for strand D is shown at the metal n+2 layer. A strand segment for strand A is shown at the metal n+1 layer. A strand segment for strand B is shown at the metal n layer.

FIG. 4*c* illustrates a cross-sectional view of the multi-stranded magnetic component 300 (shown in FIG. 3) at line Z-Z'. A strand segment for strand C is shown at the metal n+3 layer. A strand segment for strand D and a strand segment for strand A are shown at the metal n+2 layer. A via is shown to connect the strand segment for strand D at the metal n+2 layer with the strand segment for strand D at the metal n+1 layer. A via is shown to connect the strand segment for strand A at the metal n+2 layer with the strand segment for strand A at the metal n+1 layer. A strand segment for strand B is shown at the metal n layer.

Figure 5:
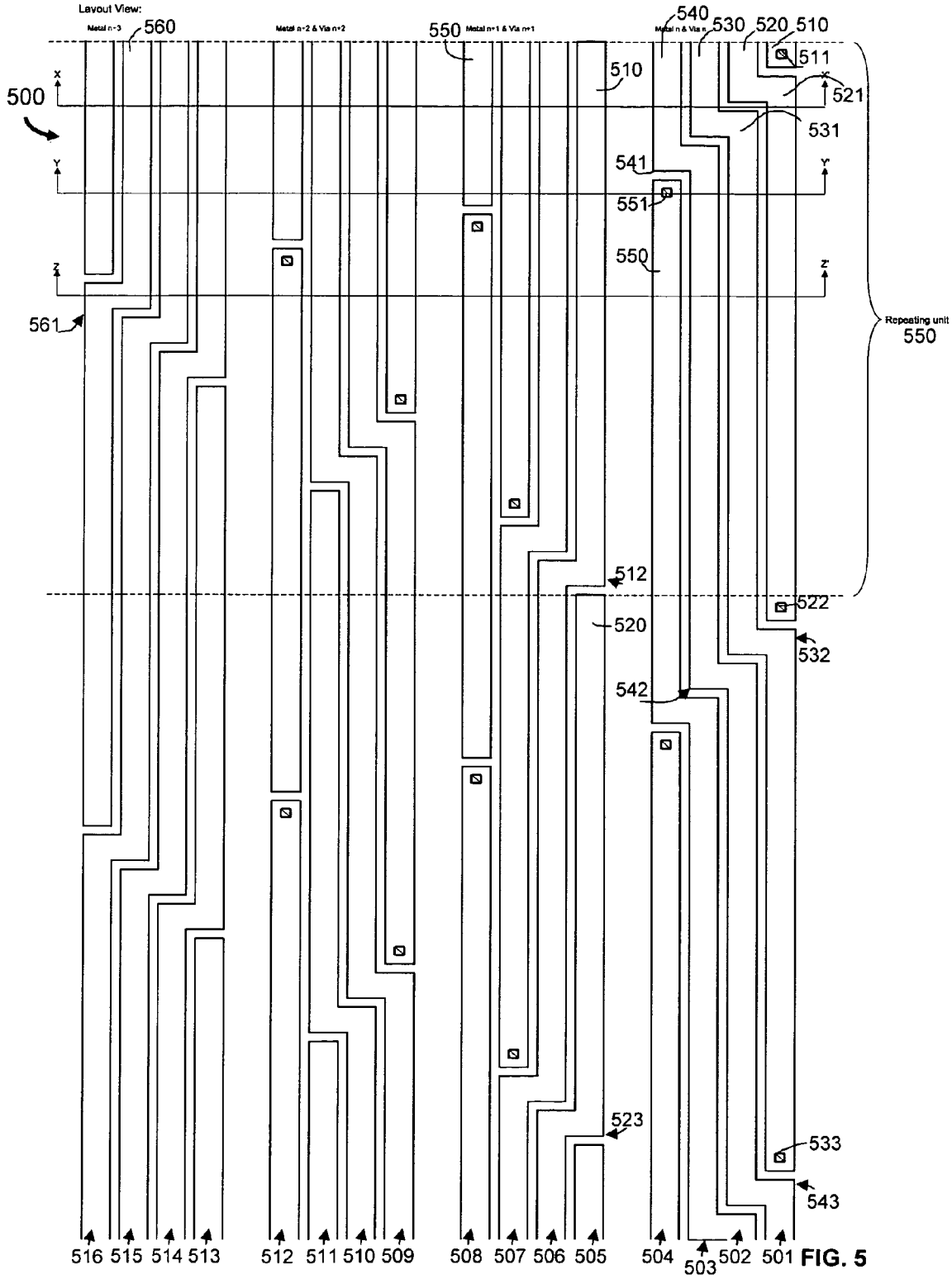
FIG. 5 illustrates a layout view of a multi-stranded magnetic component with vertical and lateral transposition according to an exemplary embodiment of the present invention.

FIG. 5 illustrates a layout view of a section of a multi-stranded magnetic component 500 with vertical and lateral transposition according to an exemplary embodiment of the present invention. The layout view illustrates four layers of the magnetic component 500, metal n, metal n+1, metal n+2, and metal n+3. A first plurality of tracks 501-504 resides on a first layer (metal n) of the magnetic component 500. The plurality of tracks 501-504 are laterally adjacent to one another. A second plurality of tracks 505-508 resides on a second layer (metal n+1) of the magnetic component 500. The plurality of tracks 505-508 are laterally adjacent to one another. A third plurality of tracks 509-512 resides on a third layer (metal n+2) of the magnetic component 500. The plurality of tracks 509-512 are laterally adjacent to one another. A fourth plurality of tracks 513-516 resides on a fourth layer (metal n+3) of the magnetic component 500. The plurality of tracks 513-516 are laterally adjacent to one another.

The magnetic component 500 includes a plurality of strands which compose the winding of the magnetic component. Each of the strands span the length of the winding and are both are vertically and laterally transposed through each of the tracks on the magnetic component. Crossing segment 511 transposes strand 510 from track 501 to track 505. Crossing segment 512 transposes strand 510 from track 505 to track 506.

Crossing segment 521 transposes strand 520 from track 502 to track 501. Crossing segment 522 transposes strand 520 from track 501 to track 505. Crossing segment 523 transposes strand 520 from track 505 to track 506. Crossing segment 531 transposes strand 530 from track 503 to track 502. Crossing segment 532 transposes strand 530 from track 502 to track 501. Crossing segment 533 transposes strand 530 from track 501 to 505. Crossing segment 541 transposes strand 540 from track 504 to track 503. Crossing segment 542 transposes strand 540 from track 503 to track 502. Crossing segment 543 transposes strand 540 from track 502 to track 501.

Other crossing segments and strands are also illustrated in FIG. 5. These strands are similarly transposed both vertically and laterally. The section of the layout labeled "Repeating Unit Cell 550" may be repeated (along the length of the winding) to further vertically and laterally transpose the strands in the winding. According to an embodiment of the present invention each of the strands in the magnetic component are transposed to occupy each of the tracks 501-516. In one embodiment, each strand occupies each of the plurality of tracks for a distance that is approximately equal. In the example illustrated in FIG. 5, 15 strands are supported by tracks 501-516. These strands are unique and electrically isolated from one another.

Figures 6A, 6B, 6C:
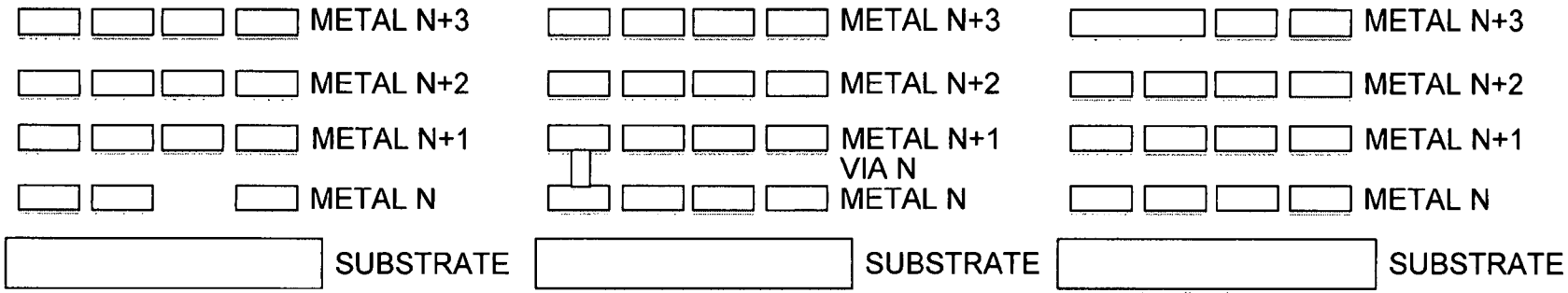
FIG. 6*a*-6*c* illustrate cross-sectional views at positions of the multi-stranded magnetic component of FIG. 5 according to an embodiment of the present invention.

FIGS. 6*a*-6*c* illustrate cross-sectional views at positions of the multi-stranded magnetic component of FIG. 5 according to an embodiment of the present invention. FIG. 6*a* illustrates a cross-sectional view of the multi-stranded magnetic component 500 (shown in FIG. 5) at line X-X'. At level metal n, no strand is shown at track 502 as strand 530 is crossing over from track 503 by way of crossing segment 531.

FIG. 6*b* illustrates a cross-sectional view of the multi-stranded magnetic component 500 (shown in FIG. 5) at line Y-Y'. Crossing segment 551 is shown to vertically transpose strand 550 from track 504 at layer metal n to track 508 at layer metal n+1.

FIG. 6*c* illustrates a cross-sectional view of the multi-stranded magnetic component 500 (shown in FIG. 5) at line Z-Z'. Crossing segment 561 is shown to horizontally transpose strand 560 from track 515 to track 516.

The crossing segments illustrated in FIGS. 2*a*-2*c*, 3, and 4*a*-4*c* are vias which vertically transpose a strand segment from one layer to another. Single vias have been illustrated to transpose a strand segment vertically. It should be appreciated, however, that more than one via may be used to transpose a strand segment vertically. In addition to vias, crossing segments may also include cross-over, cross-under, and cross-around segments, and other types of bridging components to vertically and horizontally transpose strands to laterally or horizontally adjacent tracks. In FIGS. 5 and 6*c*, cross-around segments are illustrated as crossing segments for horizontal transposition.

The multi-stranded magnetic component illustrated in FIGS. 3, 4*a*-4*c*, 5, and 6*a*-6*c* may be used to implement the spiral inductor illustrated in FIGS. 2*a*-2*d* or a transformer, balun, or other magnetic component with winding. The transposition pattern illustrated in FIGS. 3, 4*a*-4*c*, 5, and 6*a*-6*c* may be transformed into an octagonal foot print to resemble the spiral inductor illustrated in FIG. 2. Alternatively, the transposition pattern may be transformed into a square, circular, or other shaped foot print. It should also be appreciated that instead of forming a single loop pattern as shown in FIG. 2, the transposition patterns may be used to form multi-loop patterns.

Figure 7:
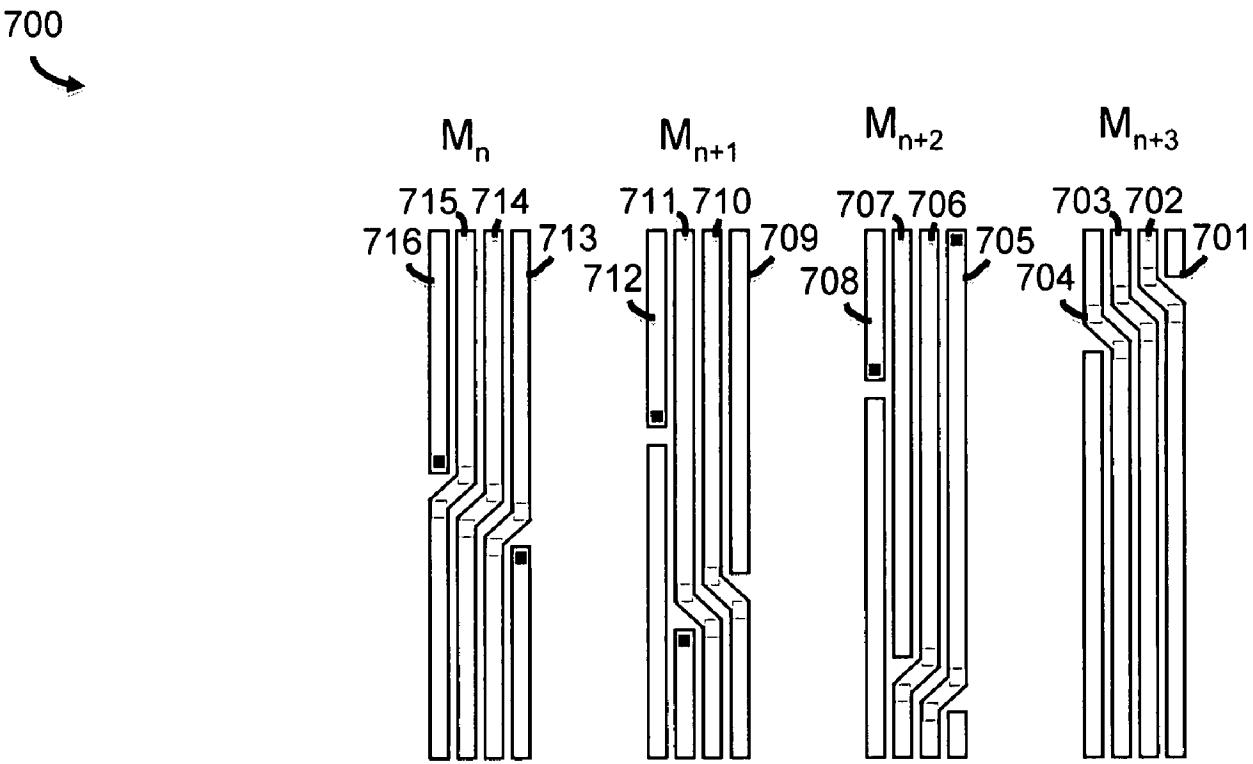
FIG. 7 illustrates a layout view of a multi-stranded magnetic component according to an alternate embodiment of the present invention.

FIG. 7 illustrates a layout view of a section of a multi-stranded magnetic component 700 with vertical and lateral transposition according to an alternate embodiment of the present invention. The layout view illustrates four layers of the magnetic component 700, metal n ($M_n$), metal n+1 ($M_{n+1}$), metal n+2 ($M_{n+2}$), and metal n+3 ($M_{n+3}$). A first plurality of tracks 701-704 resides on a first layer ($M_{n+3}$) of the magnetic component 700. The plurality of tracks 701-704 are laterally adjacent to one another. A second plurality of tracks 705-708 resides on a second layer ($M_{n+2}$) of the magnetic component 700. The plurality of tracks 705-708 are laterally adjacent to one another. A third plurality of tracks 709-712 resides on a third layer ($M_{n+3}$) of the magnetic component 700. The plurality of tracks 709-712 are laterally adjacent to one another. A fourth plurality of tracks 713-716 resides on a fourth layer ($M_n$) of the magnetic component 700. The plurality of tracks 713-716 are laterally adjacent to one another 700.

The magnetic component 700 includes a plurality of strands which compose the winding of the magnetic component. Each of the strands span the length of the winding and are both are vertically and laterally transposed through each of the tracks on the magnetic component. The black squares on the strand segments represent vias or via arrays to metal levels below.

Figure 8:
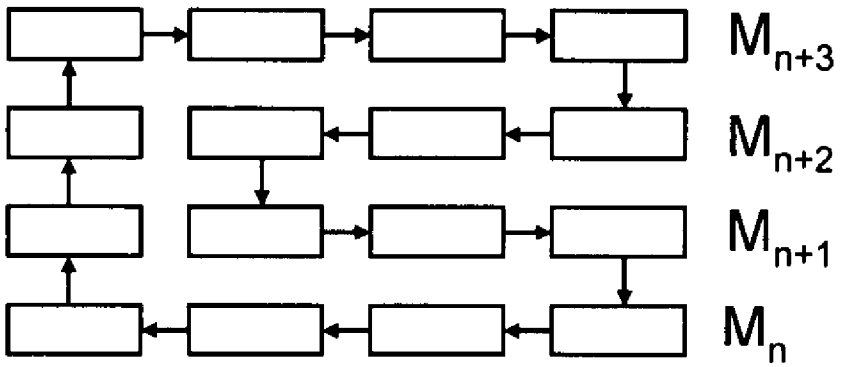
FIG. 8 illustrates a transposition sequence cross-section of the multi-stranded magnetic component illustrated in FIG. 7 according to an embodiment of the present invention.

FIG. 8 illustrates a transposition sequence cross-section of the multi-stranded magnetic component illustrated in FIG. 7 according to an embodiment of the present invention. FIG. 8 illustrates the transposition scheme for the 4 level magnetic component winding which has been divided into 15 strands. Transposition would occur 15 times or a multiple of 15 times along the winding to optimize current uniformity. In one embodiment, for S strands the transposition should occur a multiple of S times along the winding such that each strand occupies all positions (tracks) equally.

According to embodiments of the present invention, magnetic component winding is split into multiple strands to create a planar litz wire. The strands are kept electrically isolated except at the end of windings. The strands are transposed (twisted, woven, braided) along a length of the winding. In one embodiment, all possible positions (tracks) in the winding cross section are occupied equally. Transposition may occur laterally and/or vertically for multi-level metal implementations. The technique disclosed for magnetic component winding may used for inductors, transformers, balun, or other magnetic components which experiences skin and proximity effects. The transposition scheme may be applied to single turn or multi-turn magnetic components. Embodiments of the present invention may improve the high-frequency Q of spiral inductors by reducing skin effect and proximity effect. Higher Q spiral inductors enable lower phase noise of voltage controlled oscillators and improved performance of other inductor-based circuits.

In the foregoing specification embodiments of the invention has been described with reference to specific exemplary embodiments thereof. It will, however, be evident that various modifications and changes may be made thereto without departing from the broader spirit and scope of the embodiments of the invention. The specification and drawings are, accordingly, to be regarded in an illustrative rather than restrictive sense.

What is claimed is:

1. A spiral inductor, comprising:

a winding that includes a plurality of strands;

a plurality of tracks, including a first set of tracks positioned adjacent to one another on a first of layer and a second set of tracks positioned adjacent to one another on a second layer, each of the plurality of tracks capable of supporting one of the plurality of strands; and a plurality of crossing segments to transpose one or more of the plurality of strands to each of the plurality of tracks, wherein each of the plurality of strands is electrically isolated from the other plurality of strands.

2. The apparatus of claim 1, wherein each of the plurality of strands occupies each of the plurality of tracks for a distance that is approximately equal.

3. The apparatus of claim 1, wherein each of the plurality of tracks spans a distance of the winding.

4. The apparatus of claim 1, wherein each of the plurality of tracks is used to support each of the plurality of strands.

5. The apparatus of claim 1, wherein each of the plurality of tracks occupies space that spans a distance of the winding.

6. The apparatus of claim 1, wherein supporting a strand comprises providing sufficient space to allow a strand to occupy a position on the track.

7. The apparatus of claim 1, wherein the crossing segments comprises one or more cross-over segments.

8. The apparatus of claim 1, wherein the crossing segments comprises one or more cross-under segments.

9. The apparatus of claim 1, wherein the crossing segments comprises one or more cross-around segments.

10. The apparatus of claim 1, wherein the crossing segments comprises one or more vias.

11. The apparatus of claim 1, wherein the crossing segments route a strand from a first track on a first metal layer to a second track on a second metal layer.

12. The apparatus of claim 1, wherein the crossing segments route a strand from a first track on a first metal layer to a second track on the first metal layer.

13. The apparatus of claim 1, wherein the first and second layers are respective semiconductor device layers.

14. A spiral inductor, comprising:

a winding that includes a plurality of strands;

a plurality of tracks each vertically positioned to each other where each of the tracks is capable of supporting one of the plurality of strands at a position on the track; and a plurality of crossing segments to transpose one or more of the plurality of strands to each of the plurality of tracks, wherein each of the plurality of strands is electrically isolated from the other plurality of strands.

15. The apparatus of claim 14, wherein each of the plurality of strands occupies each of the plurality of tracks for a distance that is approximately equal.

16. The apparatus of claim 14, wherein each of the plurality of tracks spans a distance of the winding.

17. The apparatus of claim 14, wherein each of the plurality of tracks is used to support each of the plurality of strands.

18. The apparatus of claim 14, wherein each of the plurality of tracks occupies space that spans a distance of the winding.

19. The apparatus of claim 14, wherein supporting a strand comprises providing sufficient space to allow a strand to occupy a position on the track.

20. The apparatus of claim 14, wherein the crossing segments comprises one or more vias.

21. The apparatus of claim 14, wherein the crossing segments route a strand from a first track on a first metal layer to a second track on a second metal layer.

22. A magnetic component, comprising:

a winding that includes a plurality of strands;

a plurality of tracks, including a first set of tracks positioned adjacent to one another on a first of layer and a second set of tracks positioned adjacent to one another on a second layer, each of the plurality of tracks capable of supporting one of the plurality of strands; and a plurality of crossing segments to transpose one or more of the plurality of strands to a vertically adjacent track, wherein each of the plurality of strands is electrically isolated from the other plurality of strands.

23. The apparatus of claim 22, wherein the magnetic component is a spiral inductor.

24. The apparatus of claim 22, wherein the magnetic component is a transformer.

25. The apparatus of claim 22, wherein the magnetic component is a balun.

26. The apparatus of claim 22, wherein the winding has a square shape.

27. The apparatus of claim 22, wherein the winding has an octagonal shape.

28. The apparatus of claim 22, wherein the winding has a circular shape.

29. The apparatus of claim 22, wherein the first and second layers are respective semiconductor device layers.

* * * * *